US007172666B2

(12) United States Patent
Groves et al.

(10) Patent No.: US 7,172,666 B2
(45) Date of Patent: Feb. 6, 2007

(54) WEB MATERIAL APPLICATION METHODS AND SYSTEMS

(76) Inventors: Matthew E. Groves, P.O. Box 28, La Center, WA (US) 98629; Michael A. Fairchild, 1015 SE. 144th Ct., Vancouver, WA (US) 98683

( * ) Notice: Subject to any disclaimer, the term of this patent is extended or adjusted under 35 U.S.C. 154(b) by 239 days.

(21) Appl. No.: 10/322,309

(22) Filed: Dec. 17, 2002

(65) Prior Publication Data

US 2004/0112517 A1 Jun. 17, 2004

(51) Int. Cl.
*B32B 37/00* (2006.01)

(52) U.S. Cl. ..... 156/64; 156/256; 156/264; 156/285; 156/355; 156/519

(58) Field of Classification Search ..... 156/64, 156/250, 256, 264, 265, 269, 270, 285, 350, 156/353, 355, 510, 516, 517, 519
See application file for complete search history.

(56) References Cited

U.S. PATENT DOCUMENTS

| | | | |
|---|---|---|---|
| 2,987,108 | A | 6/1961 | Kilmartin |
| 3,075,718 | A | 1/1963 | Butler, Jr. |
| 3,580,757 | A | 5/1971 | Niepmann |
| 3,618,483 | A | 11/1971 | Helm |
| 3,660,208 | A | 5/1972 | Hubbard |
| 3,886,033 | A | 5/1975 | MacDonald et al. |
| 3,894,905 | A | 7/1975 | Ehlscheid |
| 3,939,032 | A | 2/1976 | Taitel et al. |
| 3,957,570 | A | 5/1976 | Helm |
| 4,067,760 | A | 1/1978 | Nelson |
| 4,106,974 | A | 8/1978 | Hirsch |
| 4,120,034 | A | 10/1978 | Fisk et al. |
| 4,120,739 | A | 10/1978 | Peeters et al. |
| 4,157,934 | A | 6/1979 | Ryan et al. |

(Continued)

FOREIGN PATENT DOCUMENTS

| | | |
|---|---|---|
| DE | 1 250 229 | 9/1967 |

(Continued)

OTHER PUBLICATIONS

European Patent Office Communication w/Supplementary European Search Report (Apr. 15, 2005).

*Primary Examiner*—James Sells
(74) *Attorney, Agent, or Firm*—Klarquist Sparkman, LLP

(57) ABSTRACT

Systems and methods for applying a web material to substrates are disclosed. In one example, there is provided a single first drive that may be coupled to a feed mechanism, a vacuum roll, and a rotary knife such that the respective peripheral speed of the feed mechanism, the vacuum roll, and the rotary knife is adjustable to provide a cut web material length that is in registry with a predetermined location on the substrate. In another example, there is disclosed a method that involves detecting a substrate to which a length of web material can be applied, and initiating introduction of a web material into a feed mechanism only if the substrate is detected. Another example includes introducing a web material traveling at a predetermined speed onto a vacuum roll that is positioned near a rotary knife, and rotating the rotary knife at a peripheral speed that is substantially the same as the predetermined speed of the web material traveling on the vacuum roll.

22 Claims, 11 Drawing Sheets

U.S. PATENT DOCUMENTS

| | | | |
|---|---|---|---|
| 4,181,558 | A | 1/1980 | Neubronner |
| 4,190,483 | A | 2/1980 | Ryan et al. |
| 4,332,635 | A | 6/1982 | Holbrook et al. |
| 4,364,787 | A | 12/1982 | Radzins |
| 4,405,066 | A | 9/1983 | Roccaforte |
| 4,450,039 | A | 5/1984 | Salvucci et al. |
| 4,481,053 | A | 11/1984 | Tokuno et al. |
| 4,506,816 | A | 3/1985 | Roccaforte |
| 4,580,709 | A | 4/1986 | Roccaforte |
| 4,589,943 | A | 5/1986 | Kimball et al. |
| 4,668,328 | A | 5/1987 | Kyytsonen |
| 4,720,320 | A | 1/1988 | Niemi |
| 4,722,489 | A | 2/1988 | Wommer |
| 4,795,510 | A | 1/1989 | Wittrock et al. |
| 4,917,327 | A | 4/1990 | Asbury et al. |
| 4,925,521 | A | 5/1990 | Asbury et al. |
| 5,021,111 | A | 6/1991 | Swenson et al. |
| 5,029,768 | A | 7/1991 | Asbury et al. |
| 5,078,311 | A | 1/1992 | Taguchi et al. |
| 5,224,405 | A | 7/1993 | Pohjola |
| 5,415,716 | A | 5/1995 | Kendall |
| 5,429,576 | A | 7/1995 | Doderer-Winkler |
| 5,501,763 | A | 3/1996 | Ueda et al. |
| 5,573,626 | A | 11/1996 | Rossini et al. |
| 5,624,526 | A | 4/1997 | Perecman et al. |
| 5,692,699 | A | 12/1997 | Weirauch et al. |
| 5,772,150 | A | 6/1998 | Spatafora |
| 5,775,629 | A | 7/1998 | Cyr |
| 5,839,634 | A | 11/1998 | Pollard et al. |
| 5,913,991 | A | 6/1999 | Kubota et al. |
| 5,947,360 | A | 9/1999 | Frank |
| 6,007,660 | A | 12/1999 | Forkert |
| 6,013,148 | A | 1/2000 | Bluemle |
| 6,149,755 | A * | 11/2000 | McNichols et al. ..... 156/264 |
| 6,172,698 | B1 | 1/2001 | Iwata et al. |
| 6,173,876 | B1 | 1/2001 | Sano et al. |
| 6,893,528 | B2 | 5/2005 | Middelstadt |
| 2002/0050324 | A1 | 5/2002 | Middlestadt et al. |

FOREIGN PATENT DOCUMENTS

| | | |
|---|---|---|
| DE | 42 09 262 | 10/1992 |
| EP | 0 776 848 A2 | 11/1995 |
| EP | 0 691 267 | 10/1996 |
| EP | 1 132 325 | 9/2001 |
| GB | 2 143 802 | 2/1985 |
| GB | 2 315 041 | 1/1998 |
| JP | 8-309890 | 11/1996 |
| WO | WO 96/35574 | 11/1996 |
| WO | WO 00/15729 | 3/2000 |
| WO | WO 02/39219 A2 | 5/2002 |

* cited by examiner

WEB MATERIAL APPLICATION METHODS AND SYSTEMS

FIELD OF THE DISCLOSURE

The present disclosure relates to methods and systems for applying a web material to a substrate.

BACKGROUND

There are various methods and systems for applying a web material to a substrate. One recurring problem with such methods and systems is their inability to continuously cut lengths of web material, and then register these cut lengths with a desired location on the substrate as the cut lengths are applied to the substrate. Another problem is the need to stop production on the systems in order to adjust or reconfigure the system to accept substrates of a different size or shape or to re-position the location of the application of the web material. A further shortcoming is the difficulty of efficiently operating such systems at high substrate speeds (typically about 600 to about 1000 feet per minute (about 182 meters to about 305 meters per minute).

SUMMARY OF THE DISCLOSURE

Presently disclosed is a system for applying web material to a substrate. The system may include a feed mechanism configured to advance web material along a predetermined path, and a vacuum roll configured to receive the web material advanced by the feed mechanism. A rotary knife may be positioned near the vacuum roll, and configured to engage the web material in at least one location on the vacuum roll to cut the web material into a cut web material length for applying to a substrate. A single first drive may be coupled to the feed mechanism, the vacuum roll, and the rotary knife such that the respective peripheral speed of each of the feed mechanism, the vacuum roll, and the rotary knife are adjustable to provide a cut web material length that is in registry with a predetermined location on the substrate.

Also disclosed is a method for applying web material to a substrate. The method may include introducing a web material traveling at a predetermined speed onto a vacuum roll that is positioned near a rotary knife. The rotary knife is rotated at a peripheral speed that is substantially the same as the predetermined speed of the web material traveling on the vacuum roll so as to cut the web material to form a length of web material. The length of web material then is applied to a substrate. The timing of each cutting of the web material may be controlled so as to register the position of the length of web material with a predetermined location on the substrate.

A further method for applying web material to a substrate is also disclosed. This method includes detecting the presence or absence of a substrate, registry indicia on a substrate, or a predetermined length of substrate, to which a length of web material can be applied. Introduction of a web material into a feed mechanism is initiated only if the presence of a substrate, registry indicia, or predetermined substrate length is detected. The web material supplied from the feed mechanism is continuously cut into individual lengths of web material. The length of web material then is applied to the substrate. The timing of each cutting of the web material may be controlled so as to register the position of the length of web material with a predetermined location on the substrate.

BRIEF DESCRIPTION OF THE DRAWINGS

The systems and methods disclosed herein will be described with reference to the accompanying drawing wherein.

DETAILED DESCRIPTION OF SEVERAL EXAMPLES

Figure 1:
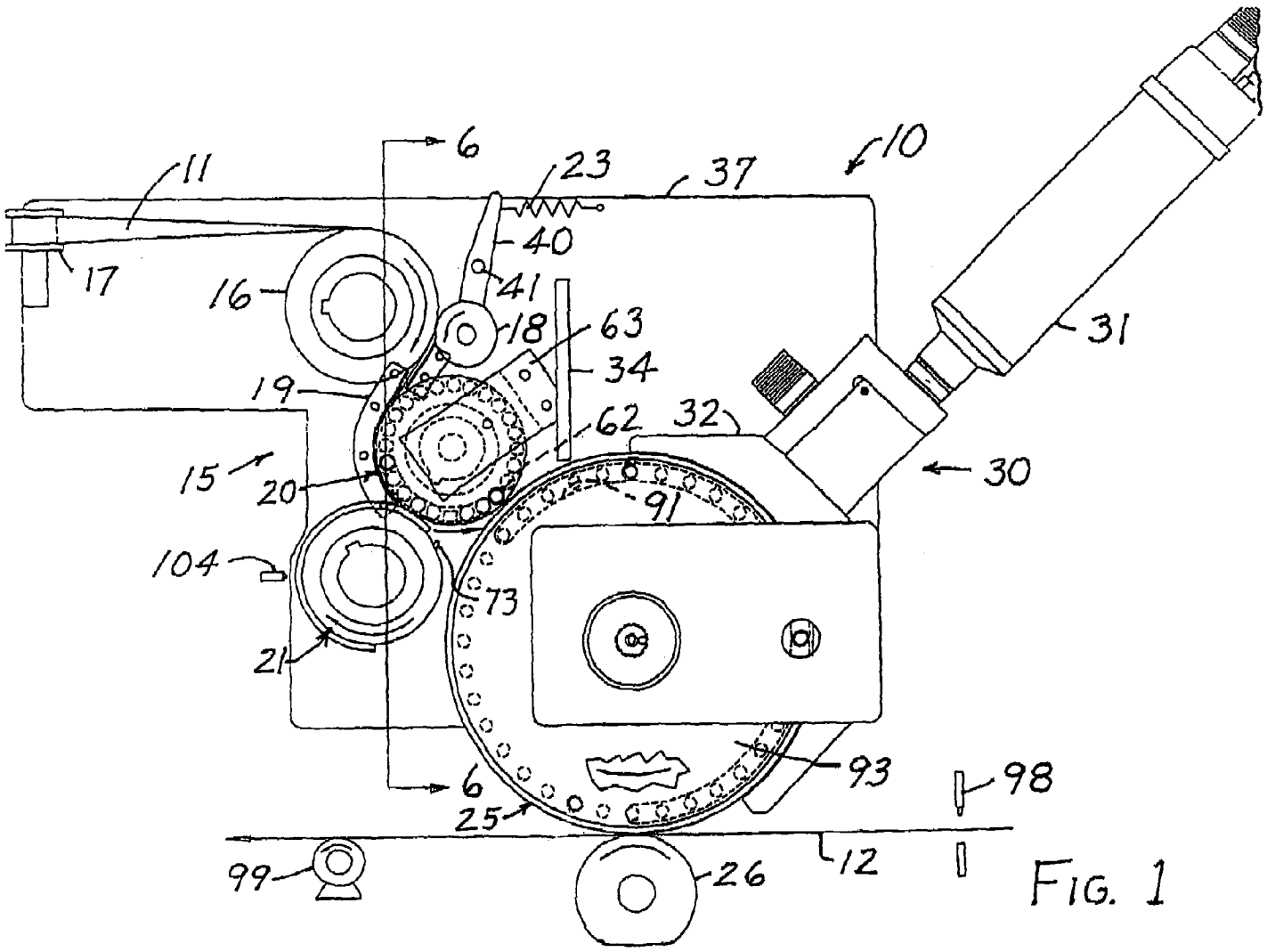
FIG. 1 is a diagrammatic fragmentary elevational view illustrating the features of a web material dispenser.
Figure 2:
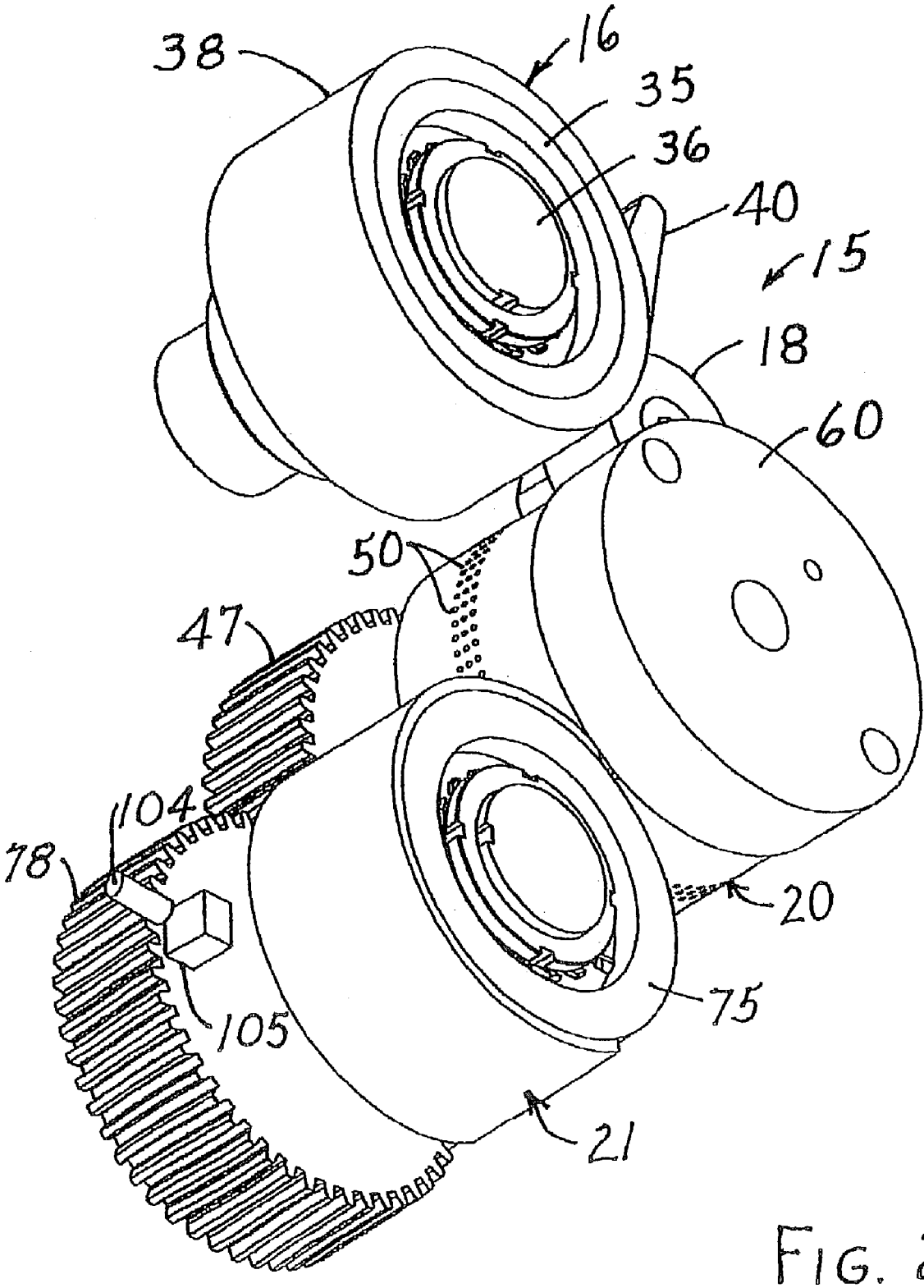
FIG. 2 is a perspective view of the feed section of the dispenser as viewed from the lower left side as shown in FIG. 1.
Figure 3:
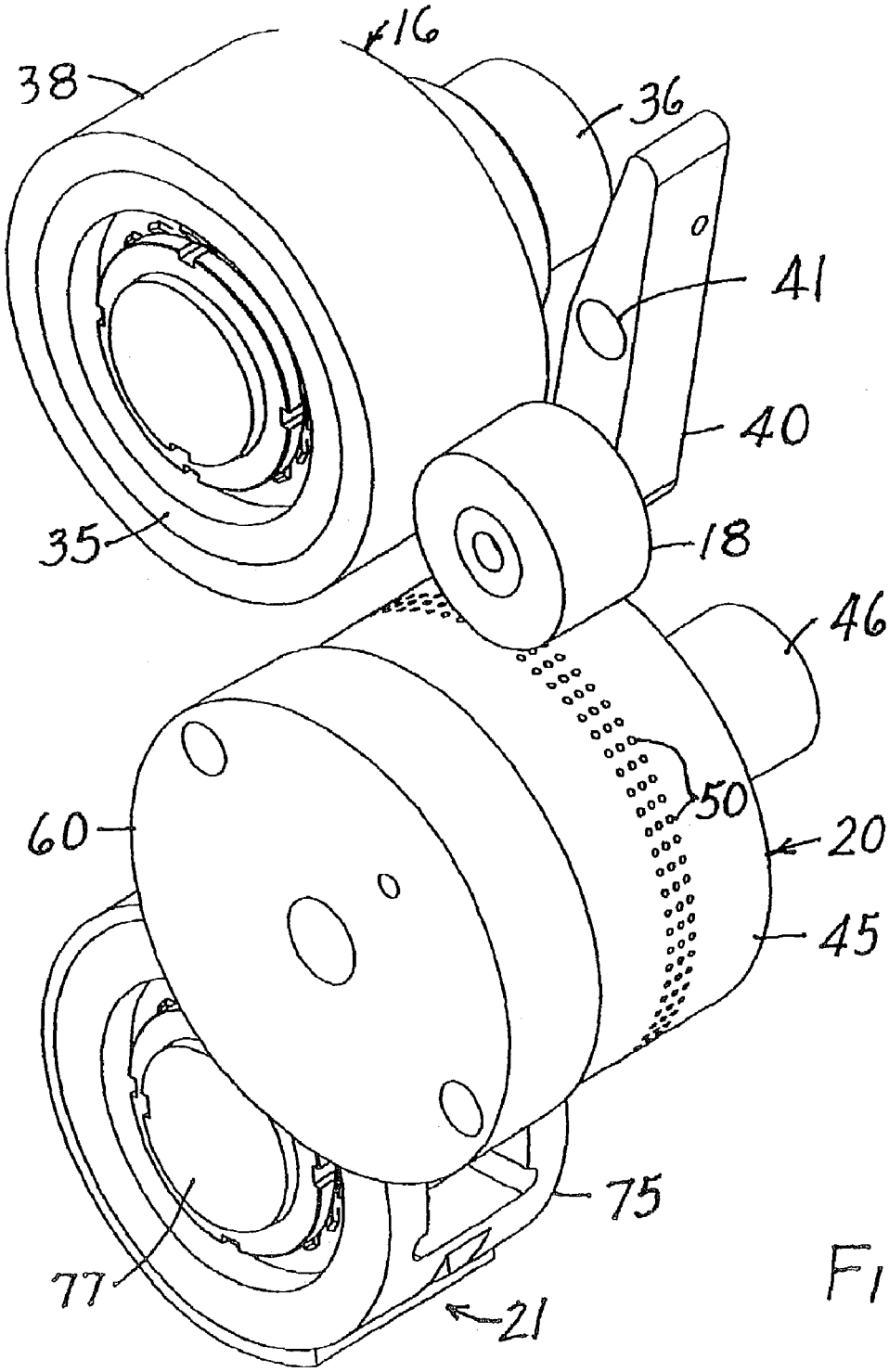
FIG. 3 is a perspective view of the feed section of the dispenser as viewed from the upper right side as shown in FIG. 1.

For ease of understanding, the following terms used herein are described below in more detail:

"Web material" (which may be used interchangeably herein with "tape") may include, but is not limited to, various ribbon material, various web materials, and various widths of material, particularly tapes with an adhesive such as a hot melt adhesive, a hot melt pressure sensitive adhesive, a hot melt remoistenable adhesive, a water dispersible hot melt adhesive, a biodegradable hot melt adhesive or a repulpable hot melt adhesive, or heat activatable adhesives. Examples of these adhesives are any typical hot melt adhesive such as an ethylene-vinyl acetate copolymer (EVA-based) hot melt adhesive; EMA-based hot melt adhesive (ethylene methylacrylate); EnBA-based hot melt adhesive (ethylene n-butyl acrylate); hot melt adhesive based on polyamides; hot melt remoistenable adhesive based on polyamides and copolyesters; hot melt adhesives based on polyethylene and polypropylene homopolymers, copolymers and interpolymers, rubbery block copolymer hot melt adhesives; or RF (radio frequency) activatable adhesives.

"Substrate" may include films, non-woven webs, paper products, paper board, carton blanks, box board, corrugated board and other sheet materials and web materials, all of various widths.

The above term descriptions are provided solely to aid the reader, and should not be construed to have a scope less than that understood by a person of ordinary skill in the art or as limiting the scope of the appended claims.

The presently disclosed methods and systems are useful with any type of web material, and with any type of substrate. In one particular example, a tape with a coating of adhesive is applied to a substrate such as, for example, a paper product.

In general, the present disclosure relates to methods and systems for continuously cutting a web material into predetermined lengths, and then continuously applying the cut lengths to a substrate or a series of substrates. The cut lengths of web material are applied so that they are in registry with a predetermined location on the substrate. The timing of the cutting determines and controls the registration of the tape with the substrate. The systems generally include a web material feed section and a web material cutting section. The web material feed section may include a feed mechanism for advancing the web material along a predetermined path through the web material cutting section. The web material cutting section may include a knife, such as a rotary knife (also referred to herein as a "rotary knife roll" or "cutting roll"), and a vacuum roll (also referred to herein as a "vacuum anvil roll"). Presently described are certain unique improvements to such methods and systems.

A first unique aspect concerns how the peripheral speed of the rotary knife, the vacuum roll, and the feed mechanism are controlled. A second unique aspect concerns how the cutting of the web material is accomplished. A third unique aspect concerns an automated system for initiating the feed of the web material. These improvements are described in more detail below in the context of the general systems and methods. A specific system or method may employ only one of the improvements disclosed herein, or it may employ more than one improvement in any desired combination.

The web material feed section typically includes a feed mechanism. The feed mechanism may be any structure or assembly that can advance the web material through the system. For example, the feed mechanism generally may include a feed roll and associated means for advancing tape from a supply (e.g., a pressure roll or increased frictional surface or a positive drive). The web material advances from the feed section to the cutting section, but it may optionally pass through other processing modules or stations between the feed section and the cutting section.

The web material cutting section typically includes a vacuum anvil roll for picking up the web material from the feed roll and a knife for cutting lengths of web material on the vacuum roll. The knife may be a rotary knife or a stationary knife. The knife is positioned near the vacuum roll for rotation with the vacuum roll. The knife engages the web material on the vacuum roll to cut the web material to the desired length. The cut length of web material may then be applied to a substrate.

In one embodiment, changes in the length of web material can be made without requiring mechanical adjustments of the basic components of the system. In particular, the feed roll and the vacuum roll may have separate drive means for rotating the feed roll and the vacuum roll. The timing of the cutting of the web material and the length of the web material piece may be adjusted independently by controlling the peripheral speeds of the feed roll and the vacuum roll. The speeds can be effectively adjusted by the use of a motor control. The positioning of a length of tape on the substrate is accomplished by an electronic controller, such as, for example, a programmable logic controller (PLC), so that the length of tape applied and the location of the tape on the substrate can be changed easily.

However, with reference to the first improvement mentioned above, another embodiment is now disclosed in which there is only a single drive, rather than separate drives, for combined rotating of the feed roll, the vacuum roll, and the rotary knife roll. Typically, the single drive is coupled to the feed roll and a vacuum roll/rotary knife roll combination or assembly. In other words, the vacuum roll and rotary knife roll usually are directly coupled together to form a unitary assembly. The single drive, typically a motor, may be coupled to a mechanical transmission assembly driving all three components—the feed roll, the vacuum anvil roll, and the rotary knife roll. The particular mechanical transmission assembly may be altered so that the respective peripheral speeds of the feed roll, vacuum roll, and the rotary knife roll are adjusted as desired. As described in more detail below, the peripheral speeds are selected so that the speed of the vacuum anvil roll and the rotary knife roll preferably is equal to or greater than the speed of the feed roll.

The mechanical transmission assembly may be any arrangement of structural elements that can transfer the rotation of the single motor drive shaft into rotating at least two separate roll drive shafts (e.g., a feed roll drive shaft and a vacuum roll drive shaft) at the same or different speeds. Such arrangements may include gearset assemblies, timing belts, chains, or similar mechanical elements. A combination of gearsets, timing belts, and/or chains may also be used. Changing the length of the web material cut may be accomplished by mechanically altering the mechanical transmission assembly so that the respective peripheral speeds are set to the desired speeds. For example, in the case of gearsets the respective peripheral speeds may be established by providing a gear ratio between a first gear coupled to the feed roll, and a second gear or gears that mesh with the first gear and are coupled to the vacuum anvil roll and the rotary knife roll. The particular gear ratio can be determined, for example, based on the desired peripheral speeds, the relative sizes of the respective rolls, the desired cut length, the number or cuts per revolution of the rotary knife, and the web material properties. Illustrations of two examples of a single motor embodiment are described in more detail below with reference to FIGS. 9 and 10.

Since there is only a single motor drive for the feed, vacuum anvil, and rotary knife roll and there is a mechanical connection between the drive shafts for each roll, the desired peripheral speeds of the rolls remain synchronized during the complete run for a given batch of substrates. In other words, since all the rotation is derived from a single motor, the potential for any undesired mistiming or asymmetry between the peripheral speeds is substantially eliminated. Consequently, the web length also remains consistent during the complete run.

As described above, the rotary knife roll engages the web material on the vacuum roll to cut the web material to the desired length. According to one embodiment the web material is cut once for each rotation of the rotary knife/vacuum anvil roll assembly. The rotary knife roll includes a single knife. In the single cut embodiment, the peripheral speed of the rotary knife roll typically is significantly greater (e.g., about 100% faster for a 10 inch web material on a 6 inch diameter vacuum roll) than the travel speed of the web material as it is advanced on the vacuum anvil roll. However, with reference to the second improvement mentioned above, another embodiment is now disclosed in which the rotary knife and the vacuum anvil roll each rotate at a peripheral speed that is substantially the same as the speed of the web material traveling on the vacuum roll. The peripheral speeds of the rotary knife and the vacuum anvil roll may be nearly the same as the web material speed. But in particular examples the peripheral speeds of the rotary knife and the vacuum anvil roll may be slightly greater (e.g., up to about 10% faster) than the web material speed. As used herein, the phrase "substantially the same" is inclusive of up to about a 10% difference between the web material speed and the peripheral speeds of the rotary knife and the vacuum anvil roll. The peripheral speeds of the rotary knife roll and vacuum anvil roll can be matched to the web material speed by at least two approaches.

Figure 11:
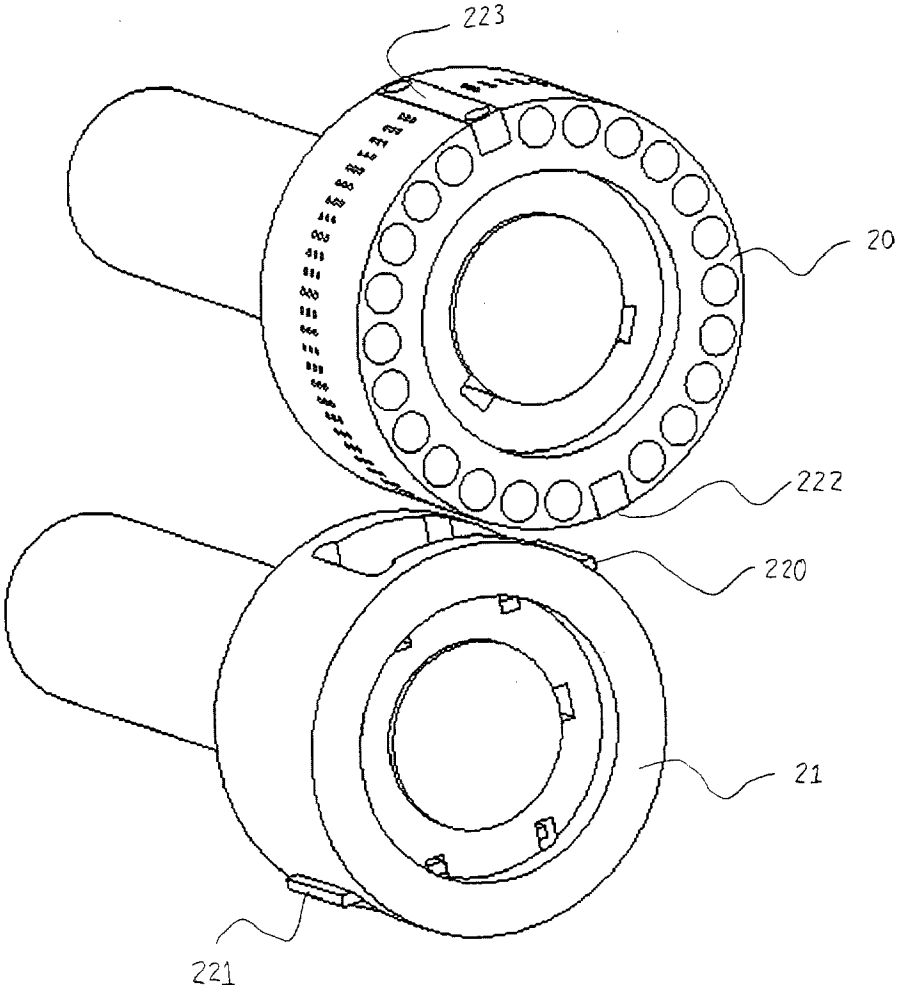
FIG. 11 is a perspective view of a rotary knife roll having two knife blades.

According to a first variant, the rotary knife roll may include two or more knives positioned at different locations on the periphery of the rotary knife roll (see FIG. 11). Thus, for each rotation of the rotary knife roll the number of cuts is equal to the number of knives. Consequently, the peripheral speed of the rotary knife roll can be substantially reduced, but still achieve the desired timing of the cuts. For example, if there are two knives on the rotary knife roll, the rotary knife roll can rotate at a speed that is 50% slower (for a given diameter vacuum roll) than the speed required for a single knife roll, but still obtain the same cut length as the single knife roll.

According to a second variant, the rotary knife roll has an outer peripheral circumference that is less than the outer peripheral circumference of the vacuum anvil roll by a predetermined ratio. For example, the rotary knife roll may have a circumference that is one-half the circumference of the vacuum anvil roll, but many other ratios are also possible. In this instance, the peripheral speed of the rotary knife roll will be substantially the same as the speed of the web material.

By matching the web material speed with the peripheral surface speeds of the rotary knife and the vacuum anvil roll, the surface of the vacuum anvil roll does not tend to "scrub" along the surface of the web material. Such "scrubbing" can cause damage to the web material. Furthermore, the cut may not occur instantaneously, but rather may occur over a certain time period of rotation of the knife roll and the vacuum anvil roll. During the cutting step the web material is pinched between the knife roll and the vacuum anvil roll, thus preventing slippage of the web material along the significantly faster moving vacuum anvil roll. Thus, the section of the web material passing through the cutting operation (i.e., the nip between the engaged knife blade and the vacuum roll) tended to stretch away from the section of the web material engaged with the feed roll. When the cut was completed, the web material could snap back and unthread the system. Matching the web material speed with the cutting according to the instant disclosure greatly reduces the tension placed on the web material between the feed section and the cutting section, and thus substantially eliminates the possibility that the web material will snap back.

As described above, a feature of the general system is that a variety of lengths of web material can be cut. In the embodiment with two separate motor drives, tape length changes can be made through a motor control and a programmable logic controller (PLC) which aid in the placement of the cut length in a precise position. In the embodiment with a single motor drive, tape length changes can be made by mechanically altering or adjusting the mechanical transmission assembly (e.g., changing the gear ratio).

Referring back to the general system, the cut web material pieces exiting the cutting section may be applied directly to the substrate. Alternatively, an application means carries the cut length of web material to the substrate. An illustrative application means comprises a vacuum wheel applicator that picks up the length of web material and retains the same on a foraminous surface to carry the length of web material about an arcuate path to an area where it is transferred to the substrate.

Adhesion application preparation means can be provided for treating the web material prior to and in preparation of application to the substrate. The preparation means may be a heater placed about a portion of the arcuate path to heat the web material as it is advanced past the heater. Such preparation means are specifically adapted for use with hot melt adhesive-coated tapes and serve to heat the adhesive to a softened state to adhere to the substrate. Alternative adhesion preparation means can also be used. For example, if a remoistenable adhesive is used, then the adhesion preparation means is a means for supplying moisture. If radiant energy, such as RF, activated adhesive is used, then the adhesion preparation means is a radiant energy source or a RF generator or system. If a pressure sensitive adhesive coated tape is used, there may not be any need for an adhesion preparation means.

In the following description of specific system examples, the reference numerals refer to like parts throughout the several figures of the drawing, unless indicated otherwise.

The system 10 may include a feed section, generally designated 15, which advances web material 11 from a supply, (not shown) and places a cut length on an applicating wheel 25 in a desired length. This applicator vacuum wheel 25 advances the cut lengths of web material 11 to a substrate 12.

The feed section 15 comprises a feed roll 16, with the non-adhesive side of the hot melt tape 11 directed toward the surface of the feed roll 16. The feed roll 16 cooperates with at least one pressure roller 18, for advancing the tape or web material 11 from a supply thereof over an idler pulley 17 and then around the feed roll 16. The web material 11 may contact, for example, about 30 to about 300 degrees of the feed roll 16. The web material 11 is then threaded between two guides 19 defining a path to a vacuum anvil roll 20, about which the web material 11 is carried to a transfer area and onto the vacuum wheel applicator 25. A rotary knife roll 21, supported for rotation on an axis parallel to the axes of the feed roll 16 and the vacuum anvil roll 20, cuts the web material 11 to the desired repeatable lengths when the relative speeds of the feed roll 16 and anvil roll 20 are set. The speeds of the periphery of the feed roll 16, the vacuum anvil roll 20 and the rotary knife 21, are changeable to change the length of tape applied to the applicator wheel 25 as the production order is changed.

The feed roll 16 may include a hub 35 fixed to a shaft 36 and rotatably supported on a frame 37 for the system 10. The hub 35 can have a tire 38 formed thereon, which may be a material having a coefficient of friction sufficient to aid in advancing the web material 11. The hub 35 is held on the shaft 36 by a threaded nut held in place by the tabs on a washer positioned against the hub and keyed to the shaft 36. The pressure roller 18 holds the tape against the feed roll 16. Alternatively, the web material may be driven by a sprocket on the feed roll.

At least one pressure roller 18 may be rotatably mounted on a lever 40 by a stub shaft and the lever 40 is pivoted on a pin 41 to move the pressure roller 18 into engagement with the tape 11 to hold it against the feed roll 16. The lever 40 may be biased by a spring, torsion or tension, as illustrated by a tension spring at 23, to urge the roll 18 toward engagement with the feed roll 16. Alternatively, the lever 40 may be actuated by a pneumatic cylinder coupled to a solenoid valve for engaging the pressure roll 18 with the feed roll 16. A further option for engaging/disengaging the feed roll is to provide a clutch that cooperates with the feed roll.

Figure 5:
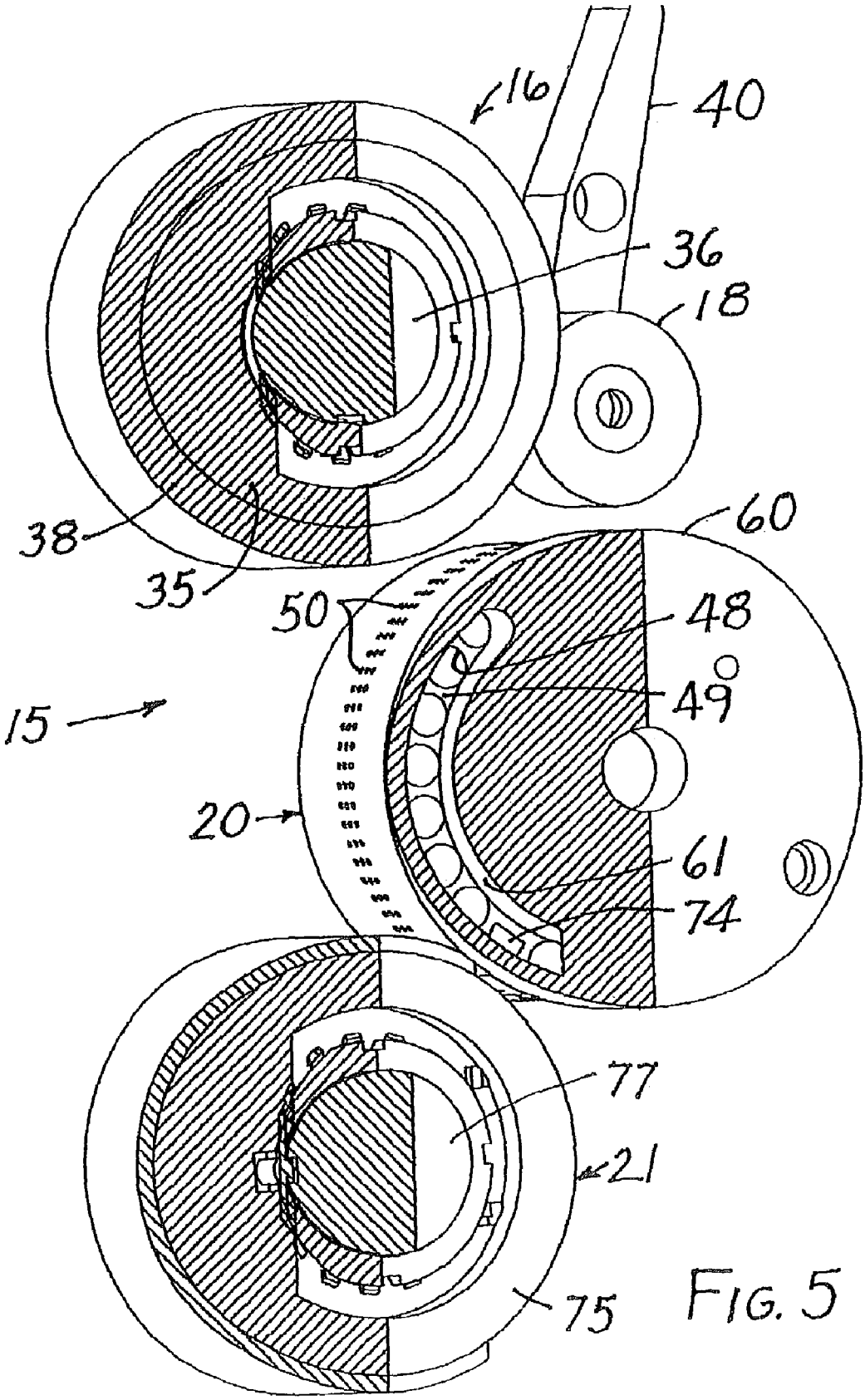
FIG. 5 is a perspective view of the feed section with parts in partial section to illustrate the structure of the various parts.

The vacuum anvil roll 20 comprises a hub 45 mounted on a shaft 46. The hub is formed of a metal or a composite material, such as cold-rolled steel, and may be coated with any nonstick material. The adhesive surface of the tape 11 contacts about 30 degrees to about 300 degrees of the surface of the vacuum anvil roll 20, preferably between 90 to 200 degrees of the surface of the vacuum anvil roll 20, and more particularly about 180 degrees of the surface. The anvil roll 20 defines a plurality of axially extending holes 48 formed in one end wall 49 of the hub 45. The holes 48 are positioned near the periphery of the roll and are spaced circumferentially to communicate with axial rows of holes 50 defined in the surface of the roll 20, and extending radially into the hub 45 from the peripheral surface. The holes 50 form a foraminous surface about the peripheral surface and near the axial midpoint of the external surface of roll 20. Each row of holes 50 communicate with one of the holes 48 formed in an end wall 49 of the hub 45. In this manner, the holes 50 are subjected to the same pressures as the holes 48. Mounted against the end wall 49 of the hub 45, is a manifold 60. The manifold 60 has a grooved arcuate slot 61 extending about 90 to 180 degrees about its end wall adjacent axially to the end wall 49 of the hub 45 (see FIGS. 1 and 5). The manifold 60 is supported in a fixed position by a bracket 63, and the slot 61 is positioned adjacent the path where the web material will engage the surface of the roll 20. The manifold 60 is also formed with a single axially extending bore 62 adjacent one end of the slot 61. This bore 62 is located in the manifold at the transition area where the leading end of the web material 11 is transferred from the vacuum anvil roll 20 to the vacuum wheel applicator 25. The slot 61 of the manifold is connected via openings in the manifold to a pump (not shown) which exhausts air from the slot 61. As the hub 45 of the vacuum roll 20 rotates, the holes 48 serially come into communication with the slot 61 and the air is exhausted from the holes 48 and from the holes 50 creating a force against one side of the web material 11 which is less than atmospheric (e.g., a vacuum), and thus the atmospheric pressure holds the web material against the foraminous surface of the roll 20 in the area of the slot 61 as it rotates the holes 48 along the slot 61. Likewise, when a hole 48 moves past the slot 61 it is aligned axially with the bore 62, and that hole 48 is subjected to pressurized air, above atmospheric, and the air passes through the holes 48 progressively as the vacuum roll 20 is rotated past the transition area and the web material is lifted from the surface of the roll 20 and picked up by the surface of the vacuum wheel applicator 25. Air couplings are joined to the outboard side of the manifold 60 permitting air to be exhausted from the slot 61 and air to be forced under pressure into the bore 62. An air line of about 0.25 inch (0.635 cm) diameter can provide adequate air to blow the web material off the anvil roll 20. It will be readily understood that as the vacuum roll 20 rotates, the holes 48 become aligned or substantially aligned with the slot 61 and the holes 50 draw the web material 11 against the surface of the vacuum roll 20. This moves the web material along with the rotation of the vacuum roll 20. When the holes 48 become aligned with the bore 62 air is forced radially outward through a row of the holes 50 against the web material 11 pushing it off the surface of the roll 20, forming the discharge means for the web material. During the continued rotation, the holes 48 are covered by the adjacent end wall of the manifold 60. The pressure holding the web material on the surface of the roll 20 over the holes 50 is such that the roll 20 can move faster than the web material 11, possibly allowing slippage of the web material 11 on the roll 20, which web material is held at a given speed by the feed roll 16.

The idea of the vacuum applied via the anvil roll 20 is to hold the leading edge of each piece of web material on the anvil roll until it can be transferred onto the vacuum wheel applicator 25. To transfer the web material onto the vacuum wheel applicator 25, the vacuum section on the anvil roll ends, followed immediately by a blow off port or jet of air under the free end of the web material to form discharge means on the anvil roll to move the web material end onto the vacuum wheel applicator. Thus, as the vacuum anvil roll rotates, the leading edge of the web material advances past the end of the vacuum created section and encounters the blow off port. The leading edge of the web material is now no longer under the control of the vacuum anvil roll. The blow off force, gravity and subatmospheric pressure, or vacuum at the surface of the vacuum wheel applicator, cause the leading edge of the web material to leave the anvil roll and to fall against the vacuum wheel applicator. As the vacuum wheel rotates, it continues to pick up more and more of the length of web material until the rotary knife makes the cut against the vacuum anvil roll. The trailing end of the cut piece continues to be held by the vacuum anvil roll, until that portion of the web material and the peripheral surface of the vacuum anvil roll rotates past the blow off port. At this point, the entire piece of web material gets transferred onto the vacuum wheel applicator. The vacuum anvil roll holds the leading edge of the next piece of web material until it too is transferred onto the vacuum applicator wheel.

Figure 6:
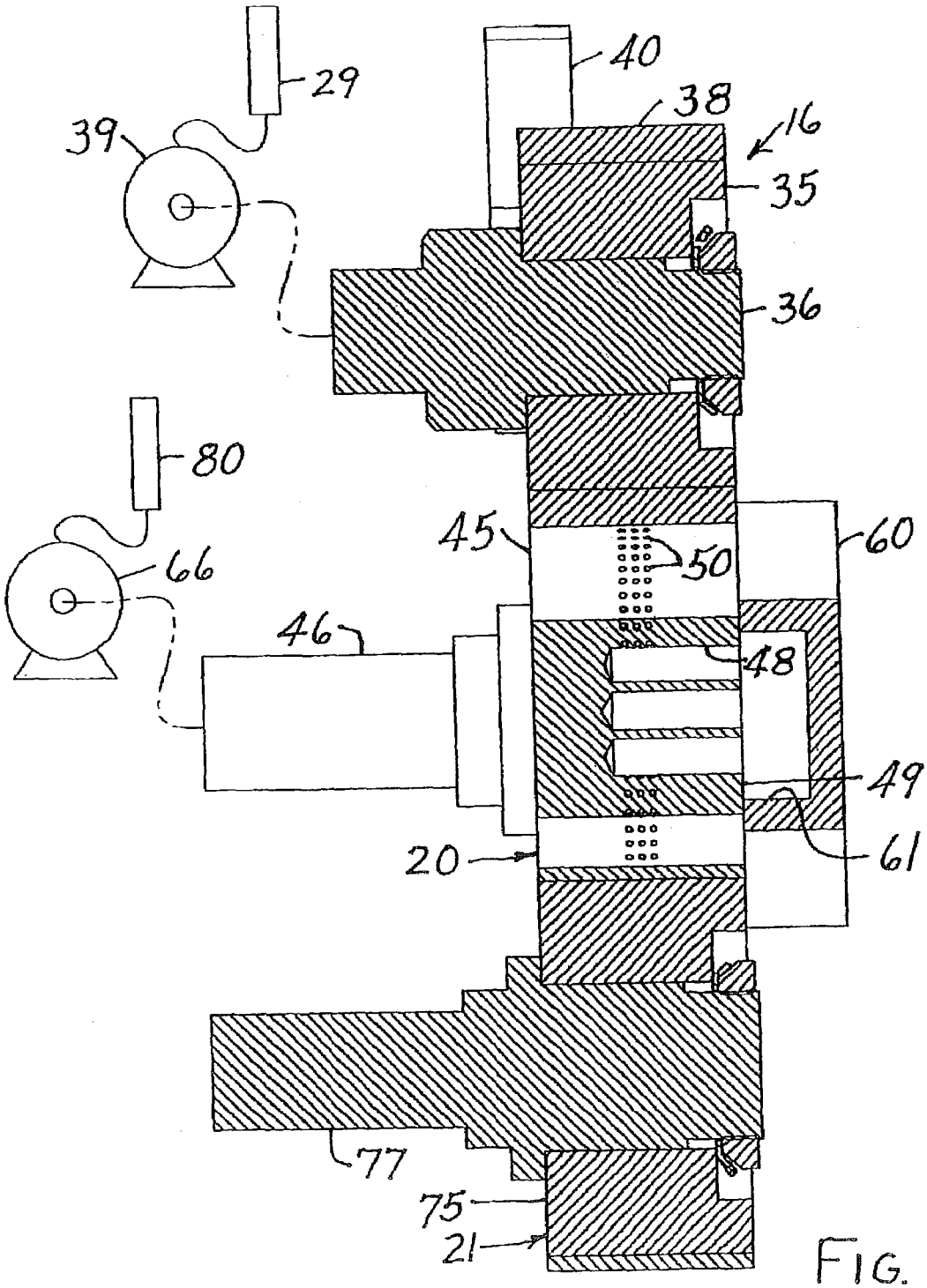
FIG. 6 is a vertical sectional view of the feed roll, the vacuum anvil roll and knife roll, as seen along line 6—6 of FIG. 1, and diagrammatically showing the drive motors and controls.
Figure 7:
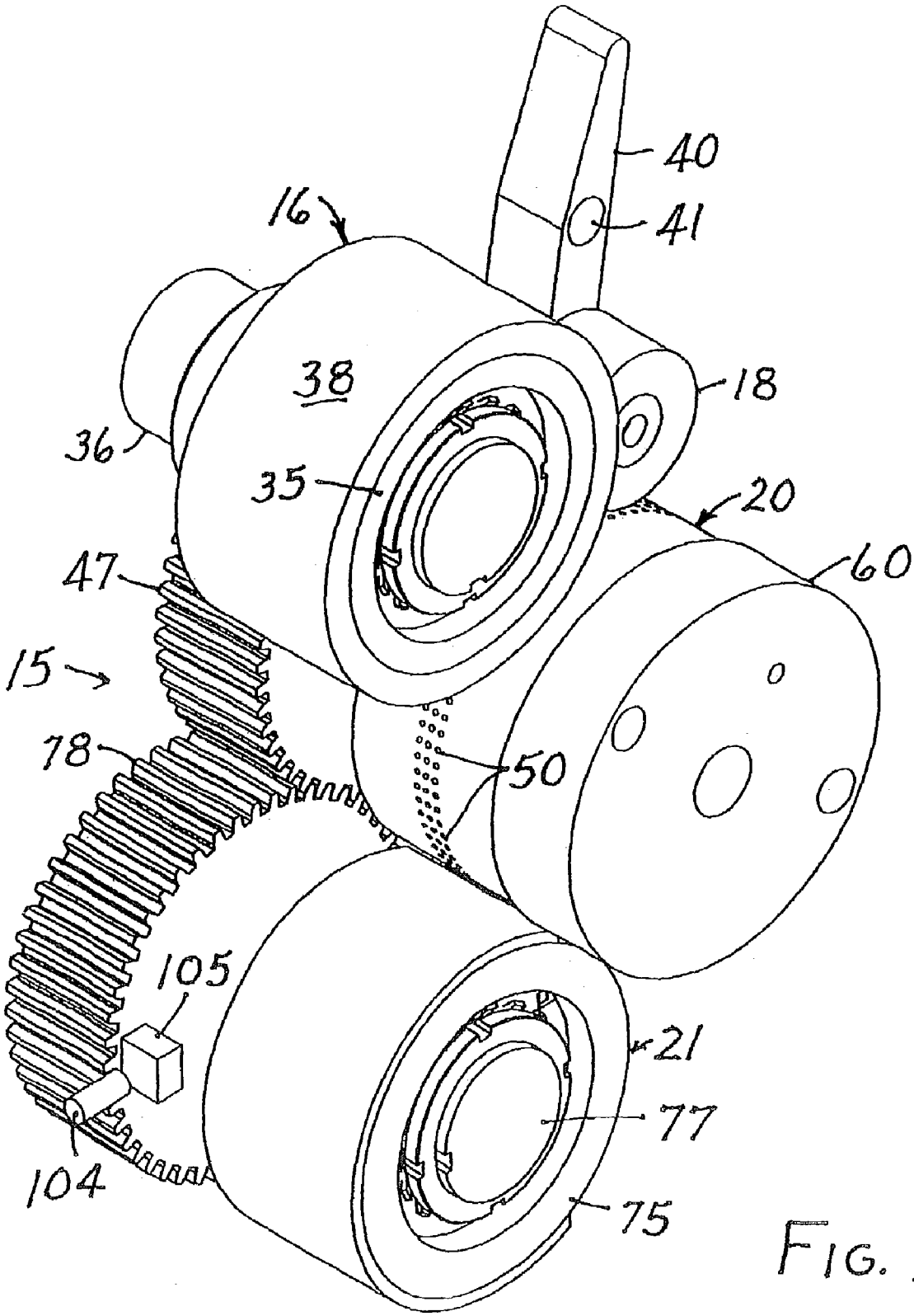
FIG. 7 is a left side perspective view of the feed section showing the drive gears for the vacuum anvil roll and knife roll and the knife sensor.
Figure 8:
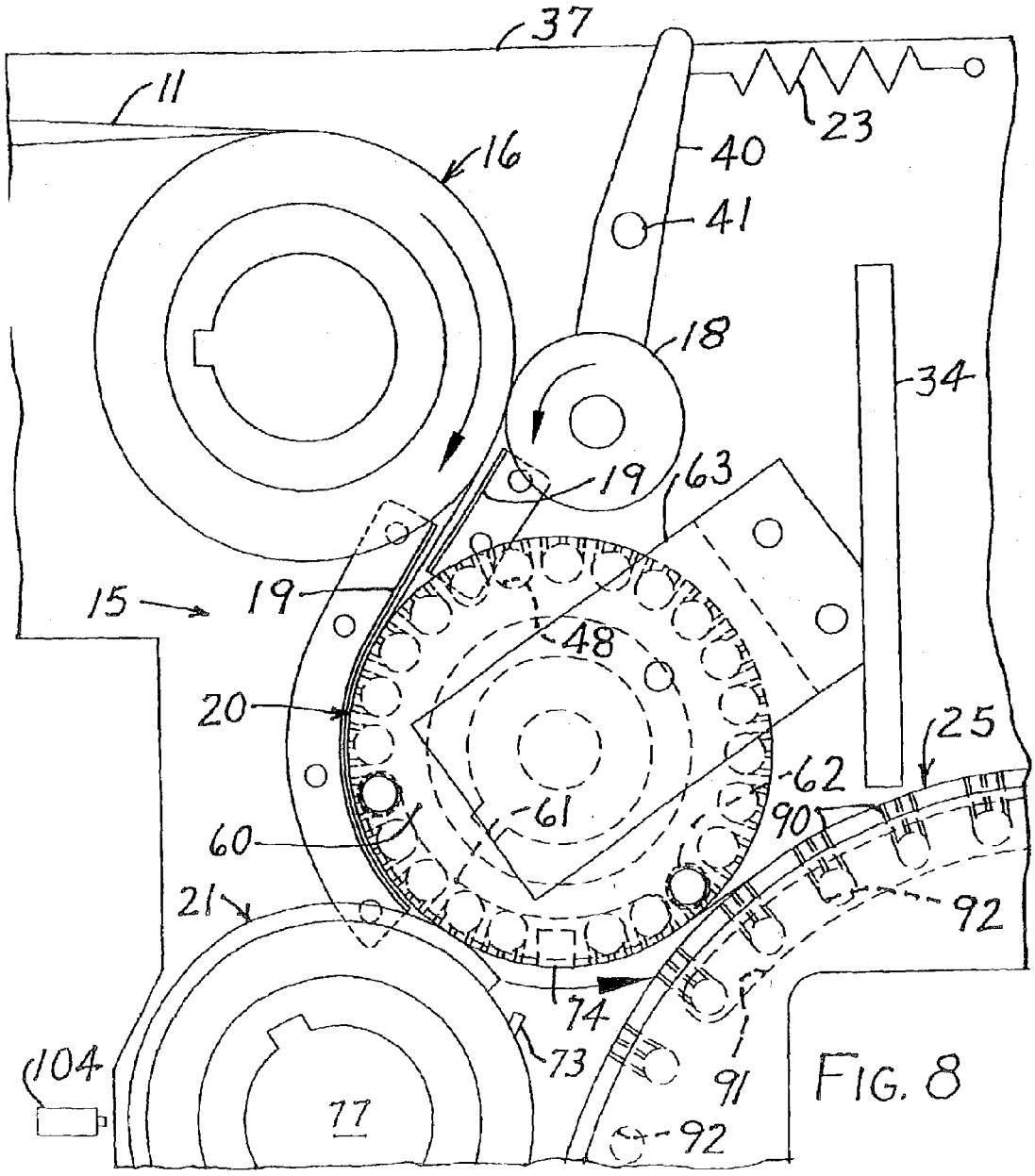
FIG. 8 is an enlarged fragmentary detail view of the feed roll, pressure roller, vacuum anvil roll and knife roll relationship.

In the embodiment depicted in FIG. 6, the vacuum anvil roll 20, having hub 45 is driven by a shaft 46. Shaft 46 is driven by a second motor 66, such as a servomotor. The motor 66 drives shaft 46 and spur gear 47, which in turn meshes with a second spur gear 78. The spur gear 78 is supported on a rotatable shaft 77, to drive that shaft and the knife roll 21. The servomotor 66 is controlled by a servomotor control 80.

Figure 4:
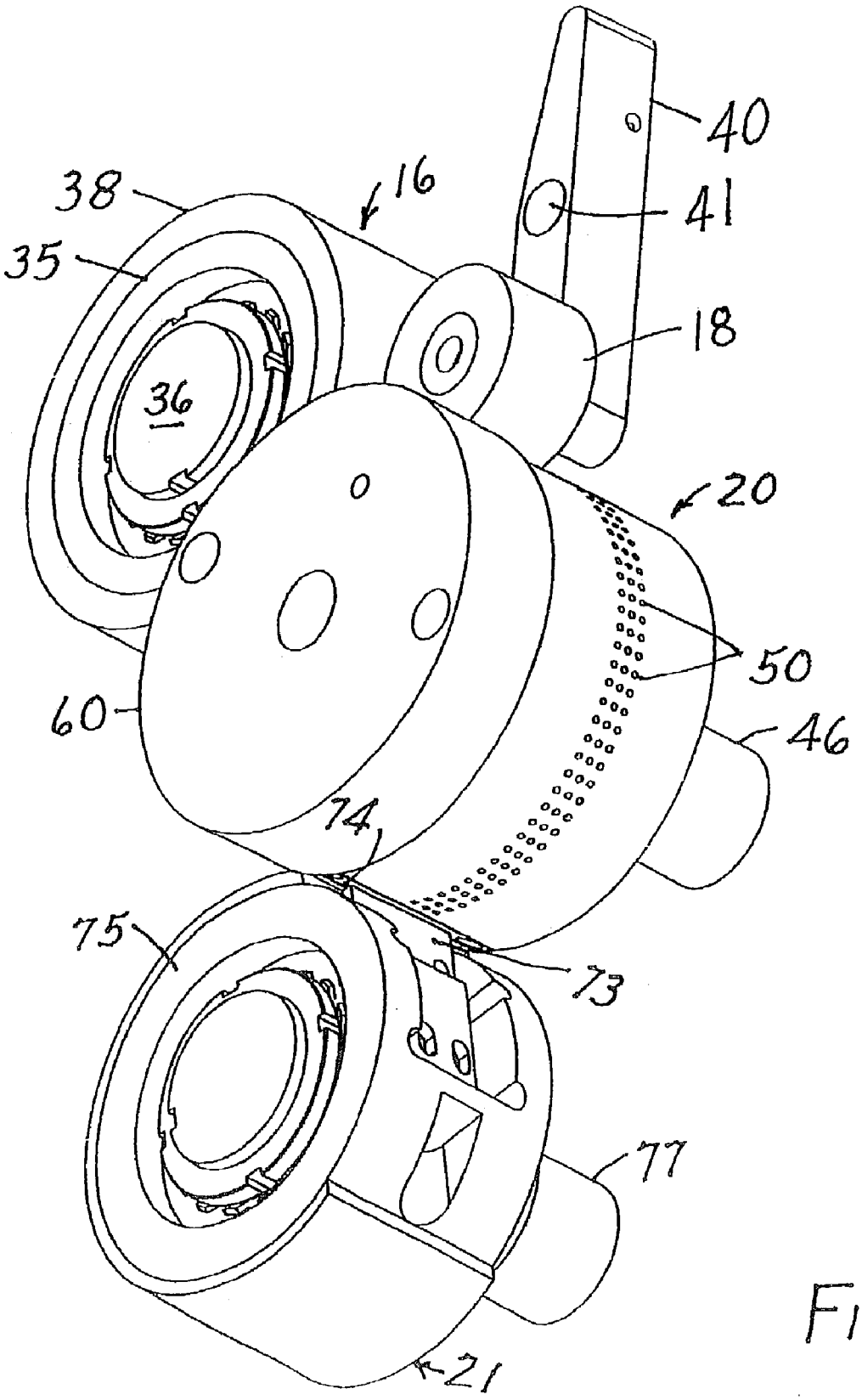
FIG. 4 is a perspective view of the feed section as viewed from the lower right side as shown in FIG. 1, with the parts rotated to show the knife roll in greater detail.

The vacuum anvil roll 20 is formed to support the tape for cutting into lengths. This cutting is accomplished by a knife blade 73 mounted in a hub 75 of the rotary knife 21 and a hardened insert 74, placed in the peripheral surface of the vacuum anvil roll 20 (see FIGS. 4 and 5). The blade 73 is a rectangular blade of steel having essentially four cutting edges. The edges forming the ends of the blade are the cutting edges. When placed in the hub 75, as shown in FIG. 4, an edge extends beyond the periphery of the hub to engage with the vacuum anvil roller 20 and affect a crush cut of the tape 11 between the hardened anvil insert 74 and an edge of the blade 73. In particular variants, a stationary knife for cutting the web material may be substituted for the rotary knife roll.

According to a first embodiment as shown in FIG. 6, a first motor 39, a DC motor operated through a DC motor controller 29, drives the feed roll 16, and a second motor 66 drives the vacuum anvil roll 20.

Figure 9:
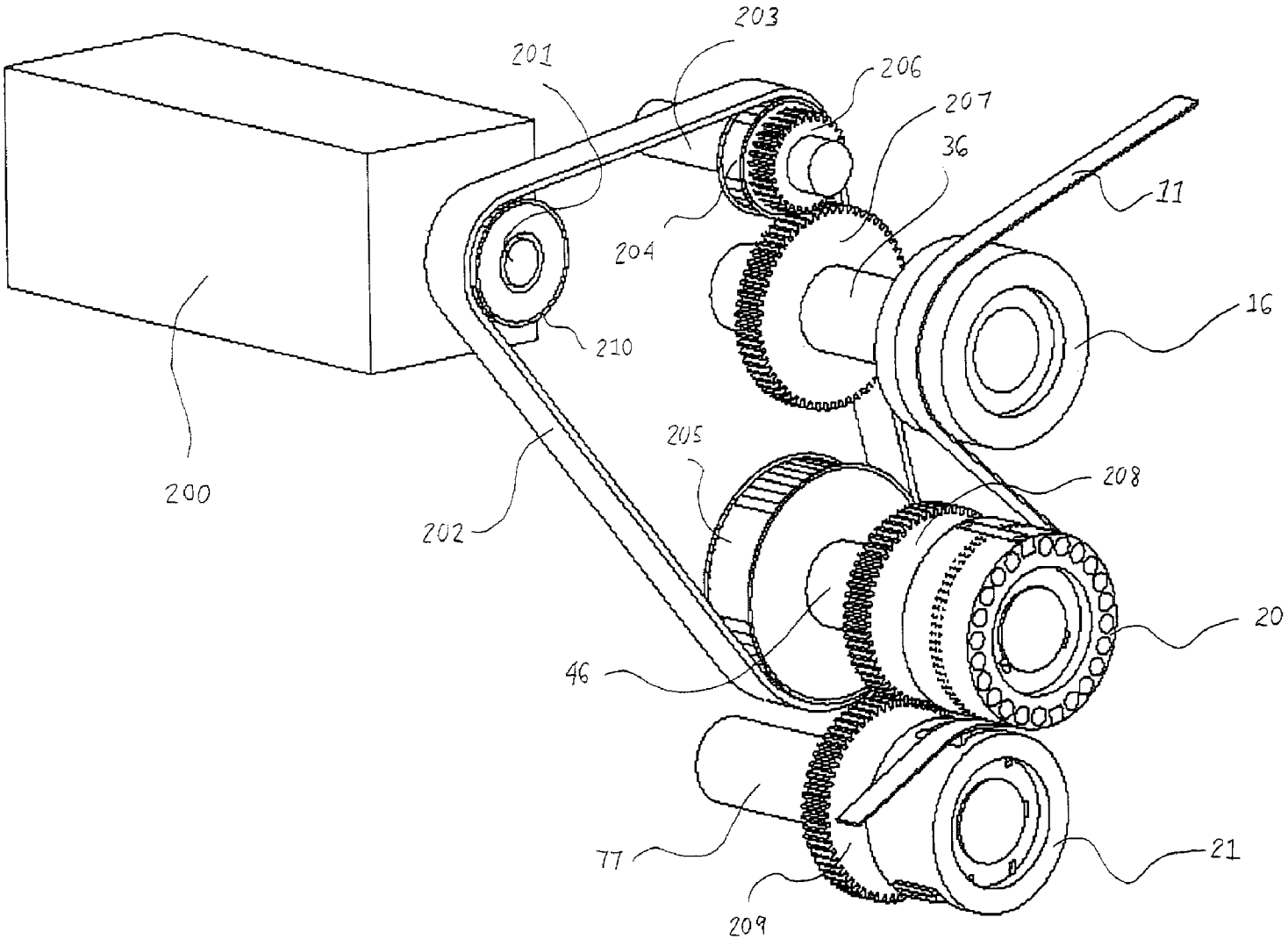
FIG. 9 is a perspective view of one example of an alternative drive configuration for the rolls.
Figure 10:
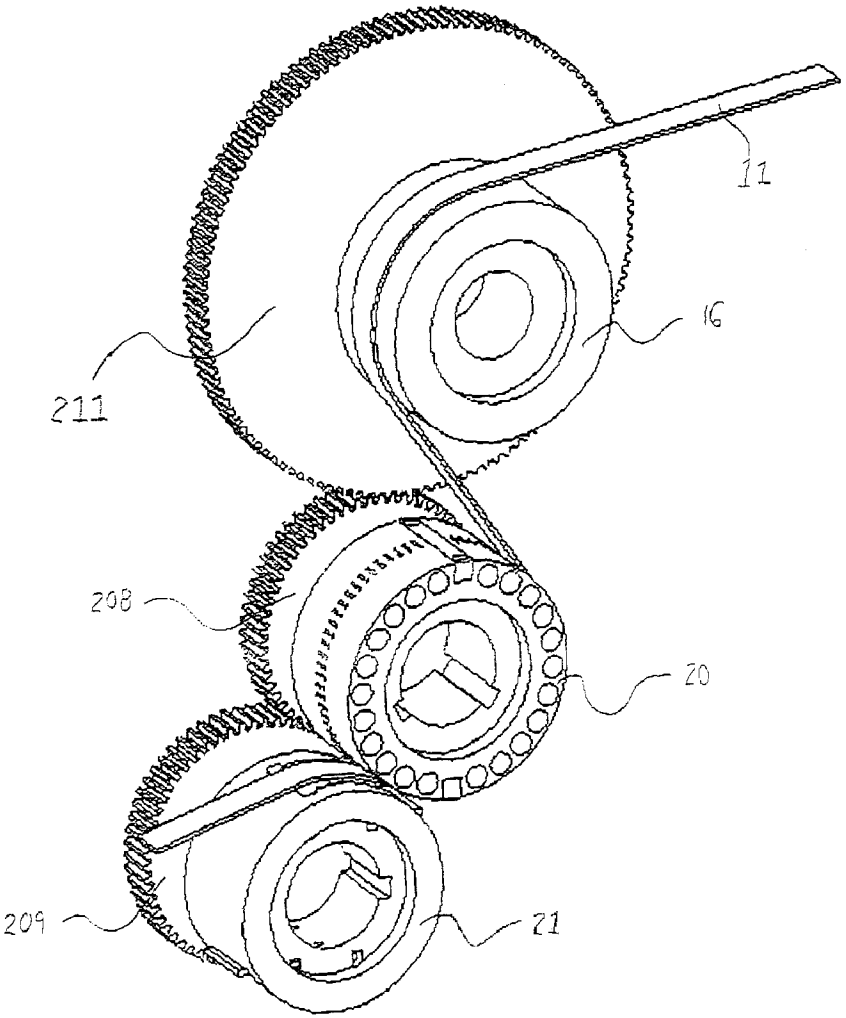
FIG. 10 is a perspective view of a second example of an alternative drive configuration for the rolls.

However, as described above another embodiment is now disclosed in which there is only a single motor driving the rolls. With reference to FIG. 9, there is provided a motor 200 that includes a drive shaft 201. A motor controller 29 may be associated with the motor 200. A timing belt 202 is reeved about a pulley 210 on drive shaft 201. The timing belt 202 is also reeved over a jack shaft 203 and the drive shaft 46 for the vacuum roll 20. A pulley 204 for receiving the timing belt 202 may be disposed on the jack shaft 203. Another pulley 205 for receiving the timing belt 202 may be disposed on the drive shaft 46 for the vacuum roll 20. The jack shaft 203 also has a drive gear 206 secured thereto that meshes with, and drives, a spur gear 207 secured to the drive shaft 36 for the feed roll 16. A spur gear 208 is secured to the drive shaft 46 for the vacuum roll 20. Spur gear 208 meshes with, and drives, an additional spur gear 209 secured to the drive shaft 77 for the rotary knife roll 21. In another alternative shown in FIG. 10, the motor 200 (not shown) and its associated drive shaft 201 (not shown) may be directly rotatably coupled to a spur gear 211 for the feed roll 16. The spur gear 211 for the feed roll 16 meshes with, and drives, the spur gear 208 for the vacuum roll 20 which in turn meshes with, and drives, the spur gear 209 for the rotary knife 21. The gear ratio of the spur gear 207 or 211 for the feed roll to the spur gear 208 for the vacuum roll 20 may be set to determine the length of the cut piece of web material, and the timing of the cutting. For example, the gear ratio may be approximately 2:1 to provide a 10 inch web material length assuming a 6 inch outer circumference for the feed roll 16. The gear ratio may be increased to shorten the cut piece, or the gear ratio may be decreased to lengthen the cut piece. In each of the examples shown in FIGS. 9 and 10, each roll is directly coupled to each other, and thus rotation of one roll will automatically rotate the other rolls at a predetermined peripheral speed ratio. Of course, it will be appreciated that the roll and drive configurations depicted in FIGS. 9 and 10 can be substituted into the general system shown in FIG. 1.

With reference back to the general system of FIG. 1, the rotary knife 21 has the hub 75 mounted on a shaft 77 that is driven either by a motor 66 and drive gears 47 and 78 or by motor 200 and gear 208 coupled to the shaft 46 of the vacuum anvil roll 20. The roll 20 and knife 21 are driven at the same speed and each time the blade 73 makes contact with the vacuum roll 20 it is at the location of the insert 74. The servomotor control 80 for the motor 66 and the DC motor controller 29 can change the relationship of the speeds of the feed roll 16 to the peripheral speed of the vacuum anvil roll 20. Alternatively, the drive gears 207, 208, and 209 can be changed to provide a different gear ratio to adjust the relationship of the speeds of the feed roll 16 to the peripheral speed of the vacuum anvil roll 20. When the speeds are the same, the length of tape fed to the applicator 25 is equal to the peripheral length of one revolution of the vacuum anvil roller 20. As the speed of the vacuum anvil roll 20 increases with respect to the peripheral speed of the feed roll 16 the lengths of tape get shorter. Thus the motor control in the FIG. 6 embodiment, or the gear ratio in the FIGS. 9 and 10 embodiments, can adjust the relative peripheral speeds but the speed of the vacuum anvil roll and rotary knife is preferably equal (=) to or greater (>) than the speed of the feed roll 16.

With reference to FIG. 11, the rotary knife roll 21 can be provided with a first knife blade 220 and a second knife blade 221. The associated vacuum anvil roll 20 may have a first hardened insert 222 that is reciprocal with the first knife blade 220, and a second hardened insert 223 that is reciprocal with the second knife blade 221. Alternatively, the entire peripheral outside surface of the vacuum anvil roll could be hardened to eliminate the need for inserts. The other elements of the rotary knife roll 21 and the vacuum anvil roll 20 shown in FIG. 11 can be the same as shown in the other figures that include a single knife blade roll. In addition, the double knife blade roll may be inserted into the general system in the same manner as the single knife blade roll.

The illustrated system 10 may also include a tape preparation system 30 for treating the web material for application to the substrate 12. In the illustrated example the preparation system is a heater comprising an air heater 31 and heat directing shroud 32 positioned about an arcuate portion of the vacuum wheel applicator 25. The cut web material section is transferred to the substrate from the surface of the vacuum wheel applicator 25, as the substrate and web material length pass between the vacuum wheel 25 and a backup roller 26. The use of the air heater 31 produces excess hot air that flows past the shroud 32. Because the web material 11 may have an adhesive coated surface adjacent the surface of the vacuum anvil roll 20, an insulative wall 34 is supported by a frame 37 and is positioned between the shroud 32 and the vacuum anvil roll 20 to restrict the heating of the roll 20. The heat shield 34 can be any sheet material that has insulation properties, such as a sheet of Micarta (Micarta is a trademarked brand of International Paper of Purchase, N.Y.). The preparation means may alternatively include a coating system to coat an adhesive to the web material on the applicator 25. Also, a web of adhesive could be transferred from a liner to the web material.

The vacuum wheel applicator 25 may be provided with a foraminous surface formed by a series of holes 90 in axial extending rows connecting with axial holes 92 in the side wall of the wheel. These holes 92 are positioned about the end wall near the periphery and during rotation or the wheel, communicate with a groove 91 in a manifold 93 which groove or slot 91 extends about 270 degrees about the circumference of the wheel 25 to carry the cut length of web material from the transfer area near the air jet 62, to the area of transfer to the substrate 12 at the application area defined by backup roller 26.

Each piece of web material must get transferred from the rotary knife/vacuum anvil roll onto the vacuum wheel applicator. The leading edge of the yet uncut web material must get directed onto the vacuum wheel applicator before the trailing edge can get cut. One discharge means, or one method of directing the web material onto the applicator is to place a web director/deflector to skive and direct the web material onto the vacuum wheel applicator. Another method is to place an air jet at the point where the web material is to transfer to direct the web material off the vacuum anvil roll toward the applicator. A third method or discharge means is to incorporate vacuum on the anvil roll. Vacuum, i.e. sub-atmospheric pressure, applied to a portion of the periphery of the anvil roll causes the leading edge of the web material to remain held against a portion of the periphery of the anvil roll as the anvil roll rotates, until the vacuum portion ceases and a blowoff port is encountered.

As described above, the cut length of web material is applied to a substrate. The substrate may be transported via a conveyor feed. The substrate conveyor feed section includes rollers and or belts, as known in the art, to move the substrate toward the nip area, and cooperating sensor 98 and a line speed encoder 99 cooperate with the electronic controls for the placing of the cut length of tape precisely on the carton or carton web.

The tape length placed upon the substrate, carton blanks or continuous carton stock, is controlled by the PLC and DC motor controller 29 for the motor 39, or alternatively by the gear ratio in combination with the electronic controller (e.g., a PLC). The PLC and motor controller 29 receive line speed information from a line speed encoder 99 positioned along the substrate feed path and driven thereby. The peripheral speed of the vacuum wheel applicator 25 is matched to the line speed of the substrate. A convenient approach for matching these speeds is to provide another motor drive coupled to both the applicator 25 and the conveyor for the substrate so that it can drive the applicator and the conveyor at the same speed. The motor can be coupled to a drive mechanism for the conveyor. In cases where the web material length extends across the entire length of the carton, the PLC and motor controller 29 for motor 39 (or motor 200), command motor 39 (or motor 200) to rotate feed roll 16 and feed web material at a rate equal to the line speed as sensed by the line speed encoder 99. When beginning a production run of cartons requiring a web material length less than that of carton length, the machine operator first puts the length of web material information into the PLC and controller 29 for motor 39 (or motor 200). For a web material length equal to one-half the carton length, motor 39 (or motor 200) would rotate feed roll 16 at a rate equal to one-half of the line speed. Any one of a multitude of web material lengths can be cut and placed on the substrate. A specific web material length is dictated by a particular carton production job order. A machine operator simply puts information into the PLC and motor controller 29 for motor 39 (or motor 200) prior to the start of the web material application production run. Any one of a multitude of web material lengths can be cut and placed as dictated by a particular carton production job order without having to stop the production line application machinery for a time sufficient to change out mechanical parts (except to change the gears in embodiments exemplified by FIGS. 9 and 10).

The presently disclosed applicator is very versatile and can be adapted to applying any discrete piece of tape of any length, at any position on a substrate of any shape or size. The length of the web material can also be varied at will.

To position the length of web material properly on the substrate, which may be box blanks which are spaced or continuous carton stock, a sensor 98 having cooperating elements, is positioned along the path of the substrate. The sensor 98 will detect the leading edge of a carton or printed registry indicia on the carton material, and send this information to the PLC and to the servomotor controller 80 (or motor controller 29). The sensor 98 also could detect whether a certain predetermined length of substrate has passed the sensor 98 that is indicative of where web material should be applied. The signal from sensor 98 may start the count to the programmable logic controller (PLC) which determines the position of the length of web material in relationship to the edge of the carton. The PLC and servomotor controller 80 and motor 66 (or controller 29 and motor 200) use this information to control the rotational speed of the vacuum anvil roll 20 and knife roll 21 in order to effect a crush cut of the tape 111 between knife 73 and anvil insert 74. Exactly when the cut gets made, relative to the position of the moving carton as the carton moves towards the nip between vacuum wheel applicator 25 and backup roller 26, defines where the web material gets positioned properly on the carton relative to the edge of the carton. For each complete revolution of the vacuum anvil wheel 20 and knife roll 21, the web material gets positioned on the carton relative to the edge of the carton. For each complete revolution of the vacuum anvil roll 20 and knife roll 21, a knife sensor 104 and a sensor lug 105 that rotates with the hub 75 detects the rotational position of the knife roll 21. In the embodiment with two knives, a second knife sensor may be provided thereby allowing the system to synchronize twice per revolution of the knife roll (i.e., once per cut). Another knife sensor may also be included to detect the location of the knife blade to ensure that a full length of web material is cut at the end of a first production run and the start of a second production run. The signal information from the sensor(s) is used to update the PLC and servomotor controller 80 (or controller 29) as to the exact position of the knife blade(s). This information is used by the PLC and servomotor controller 80 (or controller 29) to continuously control the rotational speed of the vacuum anvil roll 20 and knife roll 21, in order for a crush cut of the tape 11 to occur at the correct position for each carton.

The signal from the sensor 98 concerning the presence or absence on the conveyor of a substrate, the presence or absence of registry indicia displayed on the substrate, or the passage of a predetermined substrate length can also be used to automatically engage or disengage the pressure roll 18 to the feed roll 16. For example, when the PLC receives a signal from the sensor 98 (either directly or via a motor controller), the PLC then can generate a signal to the solenoid valve controlling the pneumatic cylinder for engagement of the pressure roll 18 to the feed roll 16. When substrates are detected by the sensor 98, the PLC sends out a signal to the solenoid valve to engage the pressure roll 18 so that web material is advanced through the system. The PLC can also regulate the solenoid activation/deactivation so that the web material length is greater than 50% of the nominal length during startup and shutdown of the system, thereby avoiding short pieces that could cause a web material jam.

According to particular examples of the system, the signal from the substrate sensor 98 and the signal(s) from the rotary knife sensor(s) are all received by at least one controller such as, for example, a PLC. The controller(s) then can generate control signals to the motor drives and the solenoid valve to synchronize together the feed of the web material, the rotational position of the knife blade(s), and the position of the substrate (or registry indicia) so that the peripheral speeds of the various rolls are set at the correct level to achieve the desired cutting. For instance, the system can provide feedback for adjusting the placement position of the cut web material pieces on substrates if there is an irregularity or non-consistent feed of individual substrates within a single production run. In certain circumstances a single production run may number in the thousands of individual substrates such as cartons. Specifically, substrate sensor 98 detects an irregularity in a substrate feed sufficiently early so that the controller can adjust the speed of the conveyor, feed roll and/or rotary knife roll to change the timing of the cut, and thus registry of the web material piece on the incoming substrates. Such adjustments can occur automatically during the single production run without having to stop the run to make a mechanical adjustment.

When beginning a production run of cartons, a machine operator first puts web material position information into the PLC and servomotor controller 80 (or controller 29) prior to the start of the web material application production run. A predetermined number of carton blanks may be fed through the system prior to web material application to allow the system to come up to speed and synchronize the rolls. Any one of a multitude of web material positions relative to an edge or index mark can be placed as dictated by a particular carton production job order without having to stop the production line application machinery in order to change out mechanical parts (or change only the gears).

The substrate used in the presently disclosed methods and systems may be a carton blank or continuous board. The length of web material applied to a carton blank can extend the full length of the carton blank or can be applied only to a portion of the carton length and at a pitch ratio related to the length of the carton blank or web and the position of the length of web material to the carton. The present system 10 is described for use with the vacuum wheel applicator 25 which takes the web material 11 advanced to it and applies the cut length to a given area on the carton blank. This places the tape in an area where the blanks are to be cut, forming a cutting edge, or alternatively, generally near a midpoint along the length of a carton blank. The tape, for example, may generally be an adhesive tape comprising a backing of between 2 about mils (0.05 mm) to about 7 mils (0.18 mm) in thickness comprised of a polymeric film selected from the group comprising polyester, polypropylene, polyethylene, and mixtures thereof. The tape and the substrate can then be cut along the center of the tape to form a serrated cutting edge for cartons used to dispense films, paper, or metal wrapping foil. Techniques for forming a cutting edge are described, for example, in commonly assigned PCT International Application Publication WO 00/15729.

In a further example, the tape placed near the midpoint may be a reinforcing tape and will then be in a position to reinforce a carrying handle, for example, on the finished carton.

The web material can be applied to the substrate at any substrate speeds. According to certain examples, the substrate speed may be about 200 to about 1200 or higher feet per minute, more particularly about 600 to 1000 feet per minute when a hot melt adhesive-containing web material is applied to carton blanks.

What is claimed is:

1. A system for applying web material to a substrate, comprising:

a feed mechanism configured to advance web material along a predetermined path;

a vacuum roll configured to receive the web material advanced by the feed mechanism;

a rotary knife positioned near the vacuum roll, and configured to engage the web material in at least one location on the vacuum roll to cut the web material into a cut web material length for applying to a substrate;

a single first drive coupled to the feed mechanism, the vacuum roll, and the rotary knife such that the respective peripheral speed of each of the feed mechanism, the vacuum roll, and the rotary knife is adjustable to provide a cut web material length that is in registry with a predetermined location on the substrate;

a rotary applicator configured to receive the cut web material length from the vacuum roll and advance the cut web material length onto the substrate; and a single second drive coupled to the rotary applicator, wherein the single second drive operates independently of the single first drive so as to allow multiple cut web material lengths to be applied at non-uniform intervals.

2. The system of claim 1, wherein the rotary knife includes more than one knife.

3. The system of claim 1, wherein the single first drive is coupled via a mechanical transmission assembly to the feed mechanism, the vacuum roll, and the rotary knife.

4. The system of claim 1, wherein the single first drive comprises a single motor, and the system further comprises a gear assembly coupling the motor to the feed mechanism, the vacuum roll, and the rotary knife, respectively.

5. The system of claim 3, wherein the mechanical transmission assembly includes at least one structural element selected from a gear, a timing belt, or a chain.

6. The system of claim 4, wherein the gear ratio of the gear assembly is adjustable to control the peripheral speed of the feed mechanism, the vacuum roll, and the rotary knife.

7. The system of claim 1, further comprising:

a conveyor configured to transport the substrate;

a first sensor positioned to detect the presence on the conveyor of a substrate or registry indicia on a substrate, and generate a first signal communicating the presence of the substrate or registry indicia; and a controller configured to receive the first signal and initiate introducing the web material into the feed mechanism if the substrate or registry indicia is present.

8. The system of claim 7, wherein the feed mechanism comprises a feed roll, a pressure roll located adjacent to the feed roll, and an actuator configured to receive an instruction from the controller to engage the pressure roll with the feed roll so that the feed mechanism can advance the web material.

9. The system of claim 8, wherein the actuator comprises a solenoid valve coupled to a pneumatic cylinder.

10. The system of claim 7, wherein the feed mechanism comprises a feed roll, and a clutch configured to receive an instruction from the controller to engage the clutch with the feed roll so that the feed mechanism can advance the web material.

11. The system of claim 7, wherein the single second drive is coupled to the conveyor and configured to drive the rotary applicator and the conveyor so that the peripheral speed of the rotary applicator and the speed of the conveyor are the same.

12. The system of claim 7, further comprising:

at least one second sensor positioned to detect the rotational position of the rotary knife and generate a second signal identifying the rotational position, wherein the controller is configured to receive the second signal and synchronize together introducing the web material into the feed mechanism, the substrate or registry indicia position, and the rotational position of the rotary knife.

13. A method for applying web material to a series of substrates, comprising:

introducing a web material traveling at a predetermined speed onto a vacuum roll, the vacuum roll being positioned near a rotary knife;

rotating the rotary knife at a peripheral speed that is substantially the same as the predetermined speed of the web material traveling on the vacuum roll so as to cut the web material to form lengths of web material;

applying the lengths of web material to a series of substrates, wherein the substrates are spaced at non-uniform intervals and the lengths of web material are applied at non-uniform intervals; and controlling the timing of each cutting of the web material so as to register the positions of the lengths of web material with predetermined locations on the substrates.

14. The method of claim 13, wherein the rotary knife includes more than one knife.

15. The method of claim 13, wherein the rotary knife has an outer peripheral circumference that is less than the outer peripheral circumference of the vacuum roll.

16. The method of claim 14, wherein the rotary knife includes two knives.

17. The method of claim 13, further comprising advancing the web material on at least a portion of a foraminous peripheral surface of the vacuum roll.

18. A method for applying web material to a substrate, comprising:

detecting the presence or absence of a substrate, registry indicia on a substrate, or a predetermined length of substrate to which a length of web material can be applied;

initiating introduction of a web material into a feed mechanism only if the presence of a substrate, registry indicia, or a predetermined substrate length is detected;

continuously cutting the web material supplied from the feed mechanism into individual lengths of web material;

applying the length of web material to the substrate; and controlling the timing of each cutting of the web material so as to register the position of the length of web material with a predetermined location on the substrate.

19. The method of claim 18, wherein the feed mechanism comprises a feed roll, a pressure roll located adjacent to the feed roll, and an actuator configured to engage the pressure roll with the feed roll when the presence of a substrate or registry indicia is detected so that the feed mechanism can advance the web material.

20. The method of claim 18, wherein the cutting of the web material comprises cutting the web material on a vacuum roll.

21. The method of claim 18, wherein the cutting of the web material is effected by a rotary knife, the method further comprising:

detecting the rotational position of the rotary knife; and synchronizing together the introducing of the web material into the feed mechanism, the substrate or registry indicia position, and the rotational position of the rotary knife.

22. The method of claim 18, wherein the feed mechanism comprises a feed roll, and a clutch configured to engage with the feed roll when the presence of a substrate or registry indicia is detected so that the feed mechanism can advance the web material.

* * * * *